US008343569B2

(12) United States Patent
Korson et al.

(10) Patent No.: US 8,343,569 B2
(45) Date of Patent: Jan. 1, 2013

(54) METHOD FOR MAKING SECURITY LASER PRINTING FILM

(75) Inventors: Robert M. Korson, Traverse City, MI (US); Wayne K. Higaki, Traverse City, MI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/190,263

(22) Filed: Jul. 25, 2011

(65) Prior Publication Data

US 2011/0278473 A1 Nov. 17, 2011

Related U.S. Application Data

(60) Continuation of application No. 12/872,473, filed on Aug. 31, 2010, now abandoned, which is a division of application No. 11/162,191, filed on Aug. 31, 2005, now abandoned.

(51) Int. Cl.
*B41M 3/14* (2006.01)

(52) U.S. Cl. ..... 427/7; 427/555; 427/157; 427/160; 283/92

(58) Field of Classification Search ..... 428/32.6, 428/32.69, 32.71, 32.87; 427/596, 7, 157, 427/160, 555; 283/92
See application file for complete search history.

(56) References Cited

U.S. PATENT DOCUMENTS 5,099,131 A 3/1992 Brownrigg et al.
5,202,265 A 4/1993 LaMora
5,301,044 A 4/1994 Wright
6,132,818 A * 10/2000 Tanaka et al. ..... 427/596
6,483,576 B1 * 11/2002 Gardner ..... 356/71
6,610,351 B2 8/2003 Shchegolikhin et al.
6,764,803 B2 7/2004 Koops et al.
6,926,764 B2 8/2005 Bleikolm et al.

(Continued)

FOREIGN PATENT DOCUMENTS

EP 0991047 4/2000

(Continued)

OTHER PUBLICATIONS

Details of Er203 acquired from http://www.webelements.com/webelements/compounds/textlEr/Er203-12061164.html on Nov. 19, 2007.*

(Continued)

*Primary Examiner* — Gerard Higgins
(74) *Attorney, Agent, or Firm* — Levenfeld Pearlstein, LLC

(57) ABSTRACT

A laser markable security laser transfer film includes a carrier web formed from a laser light-transmissive material and a taggant-containing film disposed on the carrier web. The taggant-containing film is formulated from an energy sensitive taggant capable of withstanding temperatures of at least about 1800° F. to about 2200° F. The taggant absorbs energy at a first predetermined wavelength and, in response, emits energy at a second predetermined wavelength that is different from the first wavelength. The taggant-containing film further includes a polymeric resin. The taggant-containing film is disposed on the object to be marked with the taggant-containing film adjacent the object, and laser light is directed through the film to fuse the taggant-containing film onto the object to form a taggant-containing marking on the object. When the taggant-containing marking is subjected to energy at the first predetermined wavelength, the taggant-containing marking on the object is excited and in response emits energy at the second predetermined wavelength.

6 Claims, 1 Drawing Sheet

U.S. PATENT DOCUMENTS

| | | | | |
|---|---|---|---|---|
| 7,037,561 | B2 * | 5/2006 | Narita et al. | 428/32.51 |
| 2003/0022403 | A1 | 1/2003 | Shimoda et al. | |
| 2003/0180482 | A1 | 9/2003 | Narita et al. | |
| 2004/0005180 | A1 | 1/2004 | Narita et al. | |
| 2007/0054130 | A1 | 3/2007 | Korson et al. | |
| 2010/0328415 | A1 | 12/2010 | Korson et al. | |

FOREIGN PATENT DOCUMENTS

| | | |
|---|---|---|
| GB | 2141665 | 1/1985 |
| GB | 2250233 | 6/1992 |
| WO | 98/01817 | 2/1998 |
| WO | 2004/089640 | 10/2004 |

OTHER PUBLICATIONS

Details of Yb203 acquired from http://www.webelements.com/webelements/compounds/textlYb/O3Yb2-1314370.html on Nov. 19, 2007.*

Details of V203 acquired from http://www.webelements.com/webelements/compounds/textlY/O3Y2-1314369.html on Nov. 19, 2007.*

International Search Report issued in connection with PCT/US2006/033826 on Dec. 11, 2006.

* cited by examiner

METHOD FOR MAKING SECURITY LASER PRINTING FILM

CROSS REFERENCE TO RELATED APPLICATIONS

This application is a continuation of U.S. application Ser. No. 12/872,473, filed Aug. 31, 2010, which claims the benefit of U.S. patent application Ser. No. 11/162,191 filed Aug. 31, 2005, each of which is incorporated by reference herein in its entirety.

BACKGROUND OF THE INVENTION

The present invention relates to a security marking film. More particularly, the present invention relates to a film for providing laser transferable security indicia.

Laser markable graphics have come into widespread use in many industries. Such graphics are typically applied using a laminated film or other carrier having multiple layers at least one of which includes a dye or colorant. The graphic (in the form of the dye or colorant) is transferred to an article to be marked by exposure to laser light. In a typical arrangement, the film is brought into contact with the article and the film is exposed to laser light energy.

The energy from the laser light fuses one or more of the layers with the article, resulting in the transfer of material to the article. This "prints" the indicia on the article. It has, however been found that use of laser energy to effect such a transfer generally results in high localized temperatures at the laser/film juncture site. Temperatures in the range of 1800° F. to 2200° F. are not uncommon when using lasers. As a result, laser printed graphics are typically limited to use with known dyes and pigments for providing only visibly or visually recognized indicia.

Fraud and counterfeiting result in the loss of billions of dollars annually. As such, one of today's most pressing issues is security in products and transactions. In order to deter fraud and counterfeiting, a plethora of security devices have come into use. For example, holograms are now in widespread use on, for example credit card and other securities documents (e.g., stocks and bond certificates). Radio-frequency identification (RFID) tags are also becoming popular for use in retail industries. One drawback to many of today's security devices is that they are readily identifiable as such. That is, upon viewing these devices, it is quite clear that they are in fact security devices. While this may in certain instances deter fraud and/or counterfeiting, it makes it easier to defeat these security devices.

Although security can never be perfect, it may often be more effective when the security device is difficult to identify or difficult to separate from the item that is the subject of the security measures. If the unscrupulous individual knows that there is a security device but cannot identify it, or cannot readily separate the device from the object, then that object is less likely to be the subject of fraud or counterfeiting.

Accordingly, there is a need for a security device that is not readily identifiable as a security device. Desirably, such a device is easily applied to an object through one or more known processes. More desirably, such a device is capable of incorporation into known common uses.

SUMMARY OF THE INVENTION

A laser markable security laser transfer film is formed on a carrier web of a laser light-transmissive material, as a taggant-containing film disposed on the web. The taggant-containing film is formulated from an energy sensitive (preferably infrared energy sensitive) taggant capable of withstanding temperatures of at least about 1800° F. to about 2200° F.

The taggant absorbs energy at a predetermined wavelength and, in response, emits energy at a different wavelength, preferably in the visible light spectrum. A present taggant absorbs energy in the infrared spectrum. The taggant-containing film is further formulated from a polymeric resin and can contain a pigment.

The taggant-containing film is disposed on the object to be marked with the taggant-containing film adjacent the object. A laser light is directed through the film to fuse the taggant-containing film onto the object to transfer a portion of the taggant-containing film onto the object to form a taggant-containing marking on the object. When the taggant-containing marking is subjected to energy, preferably infrared energy, at a predetermined wavelength, the taggant-containing marking on the object is excited and in response emits energy, preferably in the form of visible light at a different predetermined wavelength.

The polymeric resin can be one or more of an acrylic, a vinyl, an epoxy, a polyester, a polystyrene, a urethane, an ester and a chlorinated resin. Other resins are also contemplated.

The energy sensitive taggant is a ceramic based material. The material is capable of withstanding temperatures of at least about 1800° F. to about 2200° F. and maintain its energy (preferably IR) sensitive and energy emitting characteristics.

A system for marking an object with a laser markable security marking is also disclosed.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
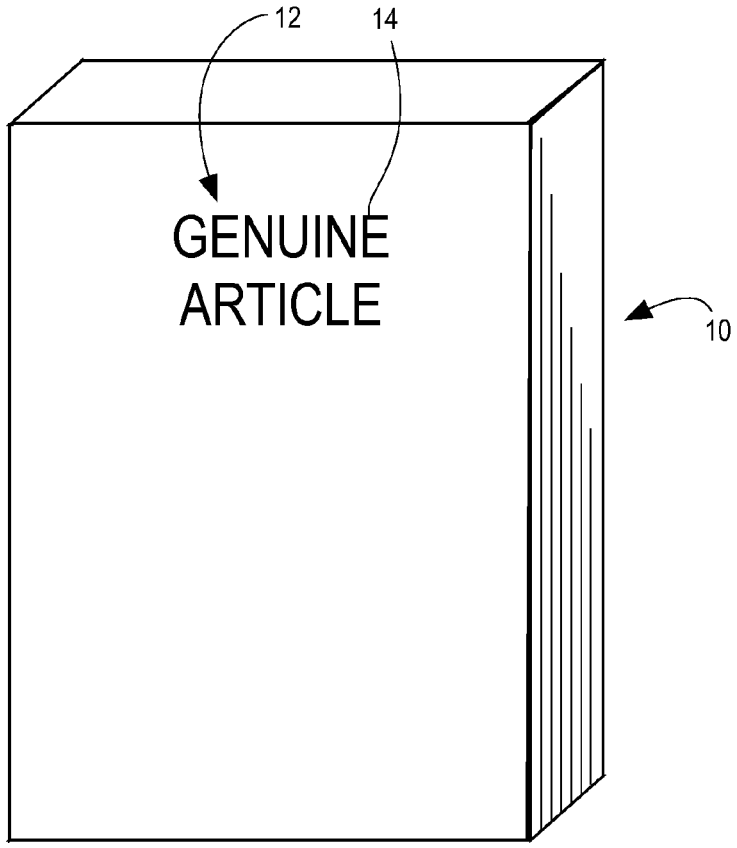
FIG. 1 illustrates an object with security laser printed indicia thereon.
Figure 2:
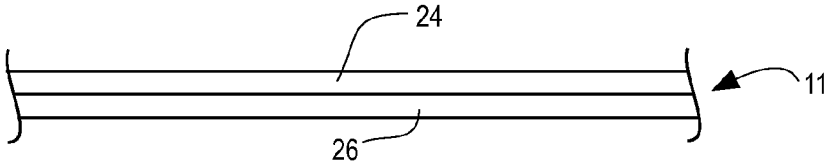
FIG. 2 is a cross-sectional illustration of a security laser transfer film embodying the principles of the present invention.
Figure 3:
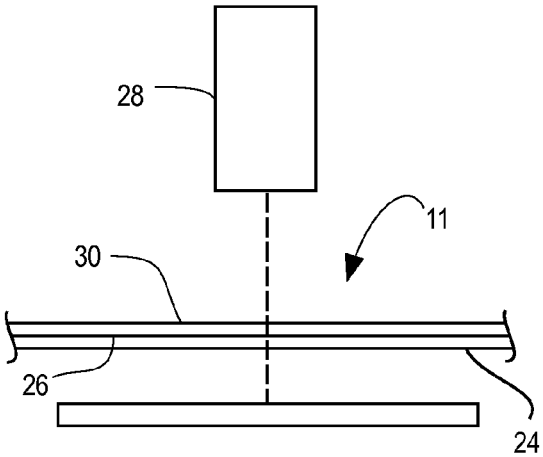
FIG. 3 is an exemplary arrangement for transferring the taggant-containing material to an object to be marked.
Figure 4:
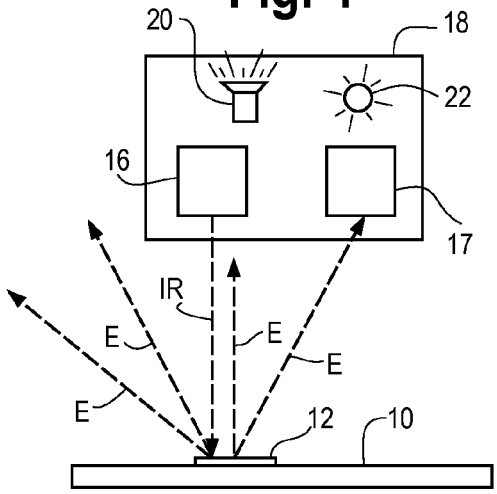
FIG. 4 is an exemplary arrangement for determining the presence of the taggant-containing material on an object that is marked.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description Of The Invention", relates to a requirement of the United States Patent Office, and does not imply, nor should be inferred to limit the subject matter disclosed herein.

In the present disclosure, the terms article, item and object may be used and are used interchangeably to describe something that is produced that has commercial value and is, for example, an item that is the subject of a commercial transaction.

Referring now to the figures and briefly, to FIG. 1, there is shown one embodiment of an object 10 having security laser printed indicia 12 thereon. The indicia 12 is referred to as security indicia in that the indicia is formed from a material 14 that includes a taggant that is not necessarily visible under normal lighting conditions (that is, to the "naked eye"). Rather, the taggant is a material that is elevated to an excited or stimulated state by exposure to energy, at a first wavelength from an energy source 16. In a present film the taggant is excited by energy in the infrared IR spectrum. The taggant, when in this excited or stimulated state emits energy E at a second predetermined wavelength that is different from the first wavelength, preferably in the visible light spectrum.

A detector 18 is used, in conjunction with the energy source 16, to detect the energy E emitted by the taggant material 14. Thus, the taggant material 14 absorbs energy IR, preferably infrared energy, emitted by the detector 18 and in turn emits energy E, preferably in the form of visible light, at a predetermined wavelength that is sensed by the detector 18. The detector 18 can be configured to emit an audible and/or visible signal (e.g., having a horn 20 and/or a light 22) to indicate the presence of the taggant material 14.

In one film, the taggant is present in a dried form (referred to as a taggant-containing film 24) on a film or foil 26 that serves as a substrate or carrier web. The dried taggant-containing film 24 on the web 26 forms the security laser printing film 11. The web 26 can be such as that known in the art, or it can be formed from a laser light-translucent or laser light-transmissive material. For purposes of the present invention, the term laser light-transmissive material includes material that is laser light-translucent. Use of this material, as will be discussed below, permits the use of a laser 28 that can be directed through the rear or back side 30 of the web 26 to carry out the transfer function. Suitable laser light-transmissive materials include polyethylene, polystyrene and polypropylene-based material. Other suitable materials will be recognized by those skilled in the art and are within the scope of the present invention.

The taggant is formulated in a liquid (e.g., a slurry) that is applied to the web 26. Upon drying, the taggant-containing film 24 is formed. The liquid includes one or more resins, pigments and the taggant. The resins can be, for example, an acrylic, a vinyl, an epoxy, a polyester, a polystyrene, a urethane, an ester, a chlorinated resin or similar thermoplastic resin system such as a cross-linked or high melt point polymer resin systems. A preferred resin is an acrylic resin.

The taggant is an energy (preferably infrared energy) IR sensitive (absorbing) and energy emitting material. The taggant absorbs energy at one predetermined frequency, preferably in the infrared spectrum, and in response emits energy, preferably in the form of light, at a different predetermined frequency. A present taggant is in a ceramic-based photoluminescent. One such taggant is commercially available under product identifier Z011, from Stardust Technologies of Bellevue, Wash. Advantageously, it has been found that such a taggant is capable of withstanding temperatures of 1800° F. to 2200° F. such that lasers 28 can be used to transfer the taggant to the object 10 without adversely effecting the energy absorbing, excitement and energy emitting characteristics of the taggant.

As set forth above, the taggant is carried in the liquid (e.g., slurry) that is applied to the carrier web 26. The liquid is applied to the web 26 and is dried to form the taggant-containing film 24 on the web 26. The security printing film 11 is placed on the object 10 to which the taggant is to be transferred with the film-formed side 24 adjacent the object 10. The laser 28 is directed through the web 26, thus exposing the rear or back side 30 of the web, and into the taggant film 24. One type of laser 28 that is used for the present taggant transfer is a fiber optic laser. Other suitable types of laser include $CO_2$ and Yag (ruby or neodymium:yttrium-aluminum garnet). The energy traverses through the web 26 into the taggant-containing film 24 and rapidly heat the film 24 causing it to flow and to spatter onto the surface of the object 10. The laser 28 makes a second pass that fuses the flowing and spattered film 24 (which now has the form of the indicia 12) to the surface of the object 10.

It has been found that a lower (laser) energy requirement is needed to transfer the present material 14. This permits the laser 28 to be operated at lower energy levels and/or at higher print speeds than current laser printing technologies. In addition, the web 26, although possibly distorted, is not fused to the object 10, but remains intact. Thus, only the taggant-containing material 14 is transferred and fused to the object 10.

A present liquid carrying the taggant is formulated having a pigment or colorant. One such pigment is a black pigment. In this manner, the indicia 12 transferred to the object 10 has both a visible as well as a non-visible (IR sensed) component, see, for example, the indicia 12 in FIG. 1. The indicia 12 is transferred to the object 10 by virtue of the taggant-containing film 24 flowing onto and being fused to the object 10. The visible component (that is, the pigment or colorant-containing component) is visible to the naked eye. The energy sensed component need not, however, be visible. The indicia 12 is passed by the detector 18 that emits energy at a predetermined wavelength, preferably in the IR spectrum. The taggant absorbs the energy and in response emits energy E, preferably in the visible light spectrum. The detector 18 includes a sensor 17 that senses energy (light) that is emitted from the taggant material 14 or indicia 12. The sensor 17 is operably connected to an indicator that provides audible 20 and/or visible 22 indication (a sound or light) of the presence of the taggant.

In a present liquid, the resin is present in a concentration of about 1.0 percent to about 50.0 percent by weight, the pigment is present in a concentration of about 20.0 percent to about 80.0 percent by weight and the taggant is present in a concentration of about 0.1 percent to about 30.0 percent by weight. In a preferred material 14, the resin is present in a concentration of about 20.0 percent to about 30.0 percent by weight, the pigment is present in a concentration of about 50.0 percent to about 70.0 percent by weight and the taggant is present in a concentration of about 5.0 percent to about 15.0 percent by weight.

It will be appreciated that the detector 18 can be configured as a table-top type of equipment item into which objects 10 are passed, or a portable device, such as a handheld device that can be carried and used in, for example, a warehouse environment.

It is anticipated that the taggant can be carried in a liquid that is formulated with a pigment that is a color other than black so that various colors can be attributed to the indicia 12. It is also anticipated that the taggant is carried in a liquid that has no pigment and is thus color-less (e.g., not visible to the naked eye).

One of the advantages of the present security laser transfer film 11 is that the taggant is capable of withstanding elevated temperatures that would otherwise destroy or render ineffectual other taggant materials.

It has also been found that greater opacity is achieved with the present security laser transfer film 11. This is achieved by a higher percentage of the pigment being transferred to the object.

All patents referred to herein, are hereby incorporated by reference, whether or not specifically done so within the text of this disclosure.

In the disclosures, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A method for marking an object with a laser markable security marking, comprising the steps of:

providing a laser markable security laser transfer film that includes a carrier web formed from a laser light-transmissive material having a taggant-containing film disposed on a first side of the carrier web, the taggant-containing film formulated from an energy sensitive taggant capable of withstanding temperatures of about 1800° F. to about 2200° F., the taggant absorbing energy at a first, predetermined wavelength and, in response, emitting energy at a second, different wavelength, the taggant-containing film further formulated from a polymeric resin;

positioning the laser markable security laser transfer film adjacent the object with the taggant-containing film on the object;

directing a laser light through the web from a second side, in a first pass, to heat the taggant-containing film and directing the laser light through the web from the second side, in a second pass, to fuse the taggant-containing film onto the object, the taggant-containing film absorbing energy at the first, predetermined wavelength, a portion of the taggant-containing film being transferred onto the object to form a taggant-containing marking on the object and emitting energy at the second different wavelength;

detecting, by a sensor, the energy emitted from the taggant-containing film at the second different wavelength; and indicating the sensed energy at the second, different predetermined wavelength.

2. The method of claim 1, wherein the first predetermined wavelength is in the infrared spectrum.

3. The method of claim 1, wherein the indication is audible.

4. The method of claim 1, wherein the indication is visible.

5. The method of claim 1, wherein the indication is audible and visible.

6. The method of claim 1 wherein the detector is hand-held.

* * * * *